US010022834B2

(12) United States Patent
Xue et al.

(10) Patent No.: US 10,022,834 B2
(45) Date of Patent: Jul. 17, 2018

(54) DEVICE FOR BURRING FRONT FACE OF WHEEL

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 26 days.

(21) Appl. No.: 15/392,514

(22) Filed: Dec. 28, 2016

(65) Prior Publication Data

US 2017/0182617 A1 Jun. 29, 2017

(30) Foreign Application Priority Data

Dec. 29, 2015 (CN) ..... 2015 1 1006474

(51) Int. Cl.
*B24B 9/04* (2006.01)

(52) U.S. Cl.
CPC ..... *B24B 9/04* (2013.01)

(58) Field of Classification Search
CPC ..... B29B 9/04; B29B 29/00; B29B 29/005
USPC ..... 451/294, 49, 51, 59
See application file for complete search history.

(56) References Cited

U.S. PATENT DOCUMENTS 4,550,464 A * 11/1985 Messing ..... B60S 3/042 15/53.4
9,724,796 B2 * 8/2017 Xue ..... B24B 9/04
9,833,873 B2 * 12/2017 Xue ..... B24B 29/005
2002/0142708 A1 * 10/2002 Bilinovich, Sr. ..... B24B 5/44 451/49

* cited by examiner

*Primary Examiner* — Robert Rose
(74) *Attorney, Agent, or Firm* — Howard IP Law Office, PA; Jeremy Howard

(57) ABSTRACT

The present invention relates to a device for burring a front face of a wheel. The device is composed of a rack, a motor, a guide rail, air cylinders, brushes and the like. A sensor enables the wheel to be positioned on a roller way, a clamping air cylinder drives left rolls and right rolls via synchronous gears and gear racks to clamp the wheel, a servo motor drives the wheel to rotate at relatively low speed under the clamped condition, and the rotation direction of the wheel is opposite to that of the brushes; the air cylinders I enable a dust cover to go down, and the motor drives a gear I and a central brush via a shaft II to rotate at relatively high speed; the gear I drives a gear II and a gear III to rotate simultaneously at slightly slow speed, so as to drive an outer ring brush to also rotate at relatively slow speed; and the air cylinders II drive the central brush and outer ring brush to go down, and burring can be performed once the central brush and outer ring brush contact the front face of the wheel. When in use, the device provided by the present invention can burr the central part and the spoke of the wheel at different rotation speeds, and the problem that the traditional big disc brush has low linear speed at the central position when rotating at fixed angular speed is avoided.

2 Claims, 2 Drawing Sheets

DEVICE FOR BURRING FRONT FACE OF WHEEL

This application claims priority from CN 201511006474.8, filed on Dec. 29, 2015, the entire content of which is incorporated herein by reference.

TECHNICAL FIELD

The present invention relates to a burring device, in particular to a device for burring a front face of a wheel.

BACKGROUND ART

During a production process of an aluminum alloy hub for an automobile, burring a front face of the hub after machining is a very important process; especially at a central riser part, burrs and flash unavoidably exist after machining, and will seriously affect the subsequent coating effect if not being removed in time. At present, the traditional method for burring the front face of the wheel is to use a big disc brush to directly burr the front face, this way has the problem that when the angular speed is a constant, the linear speed of the central part is relatively low, but the part is the place where burrs are most liable to form.

SUMMARY OF THE INVENTION

An object of the present invention is to provide a device for burring a front face of a wheel, which can burr the central part and the spoke of the wheel at different rotation speeds.

To achieve the object described above, a technical solution of the present invention is as follows: a device for burring a front face of a wheel is composed of a rack, a support plate, a guide rail, gear racks, a left sliding plate, left bearing blocks, left shafts, left rolls, a central brush, an outer ring brush, a gear I, a shaft I, a gear II, a gear ring, a swivel, a fixed plate, guide pillars, a dust cover, a shaft II, a lifting plate, lower sliding sleeves, a lower bearing block, a motor, upper sliding sleeves, air cylinders I, a gear III, a shaft III, right rolls, right shafts, right bearing blocks, a right sliding plate, a clamping air cylinder, a servo motor, synchronous gears and air cylinders II. The left sliding plate on which the two left bearing blocks are installed and under which the two gear racks are installed is fixed above the support plate via the guide rail. The two left shafts on which the left rolls are fixed are fixed in the left bearing blocks via bearings. The fixed plate is fixed under the four guide pillars. The gear ring and the swivel are fixed under the fixed plate. The gear I is installed at the lower side of the shaft II, and fixed below the fixed plate. The central brush is installed at the lowermost end of the shaft II, and fixed below the gear I. The shaft I on which the gear II is installed is fixed above the outer ring brush. The upper end of the shaft I is fixed under the inner ring of the swivel. The shaft III on which the gear III is fixed is also fixed above the outer ring brush. The upper end of the shaft III is also fixed under the inner ring of the swivel. The gear I is simultaneously engaged with the gear II and the gear III, and the gear II and the gear III are also simultaneously engaged with the gear ring. The central brush is placed at the center of the outer ring brush, and forms a certain gap with the same. The shaft II is fixed in the lower bearing block under the lifting plate via a bearing, and the upper end of the shaft II is connected with the motor fixed on the lifting plate.

The four lower sliding sleeves fixed at corresponding positions of the lifting plate are matched with the four guide pillars. The four upper sliding sleeves fixed on the top of the rack are also matched with the four guide pillars. The two air cylinders I are fixed on the top of the rack, and the output ends of the air cylinders I are hinged to the top of the dust cover. The two air cylinders II are fixed on the top of the lifting plate, and the output ends of the air cylinders II are also hinged to the top of the dust cover.

The right sliding plate on which the two right bearing blocks are fixed and under which the two gear racks are fixed is fixed above the support plate via the guide rail. The two right shafts on which the right rolls are fixed are fixed in the right bearing blocks via bearings. The two synchronous gears are fixed above the support plate, and simultaneously engaged with the two gear racks on the left and right sides. The servo motor is fixed under the right sliding plate, and the output end of the servo motor is connected with one right shaft. The clamping air cylinder is fixed on one side of the rack, and the output end of the clamping air cylinder is connected with the right sliding plate.

The gear II and the gear III are the same in module and number of teeth, the gear I has the same module as the gear II and the gear III, and the number of teeth of the gear I is half of that of the gear II and the gear III.

During actual use, a sensor enables a wheel to be positioned on a roller way, the clamping air cylinder drives the two left rolls and the two right rolls via the synchronous gears and the gear racks to clamp the wheel, the servo motor drives the wheel to rotate at relatively low speed under the clamped condition, and the rotation direction of the wheel is opposite to that of the brushes. The air cylinders I enable the dust cover to go down, and the motor drives the gear I and the central brush via the shaft II to rotate at relatively high speed. The gear I drives the gear II and the gear III to simultaneously rotate at slightly slow speed, so as to drive the outer ring brush to also rotate at relatively slow speed. The air cylinders II drive the central brush and the outer ring brush to go down, and burring can be performed once the central brush and outer ring brush contact the front face of the wheel.

When in use, the device provided by the present invention can perform burring on the central part and spoke of the wheel at different rotation speeds, the problem that the traditional big disc brush has low line speed at the central position when rotating at fixed angular speed is avoided, and the burring effect of the central part is very ideal. Meanwhile, the device provided by the present invention has the characteristics of high degree of automation, advanced technology, and safe and stable performance.

Figure 1:
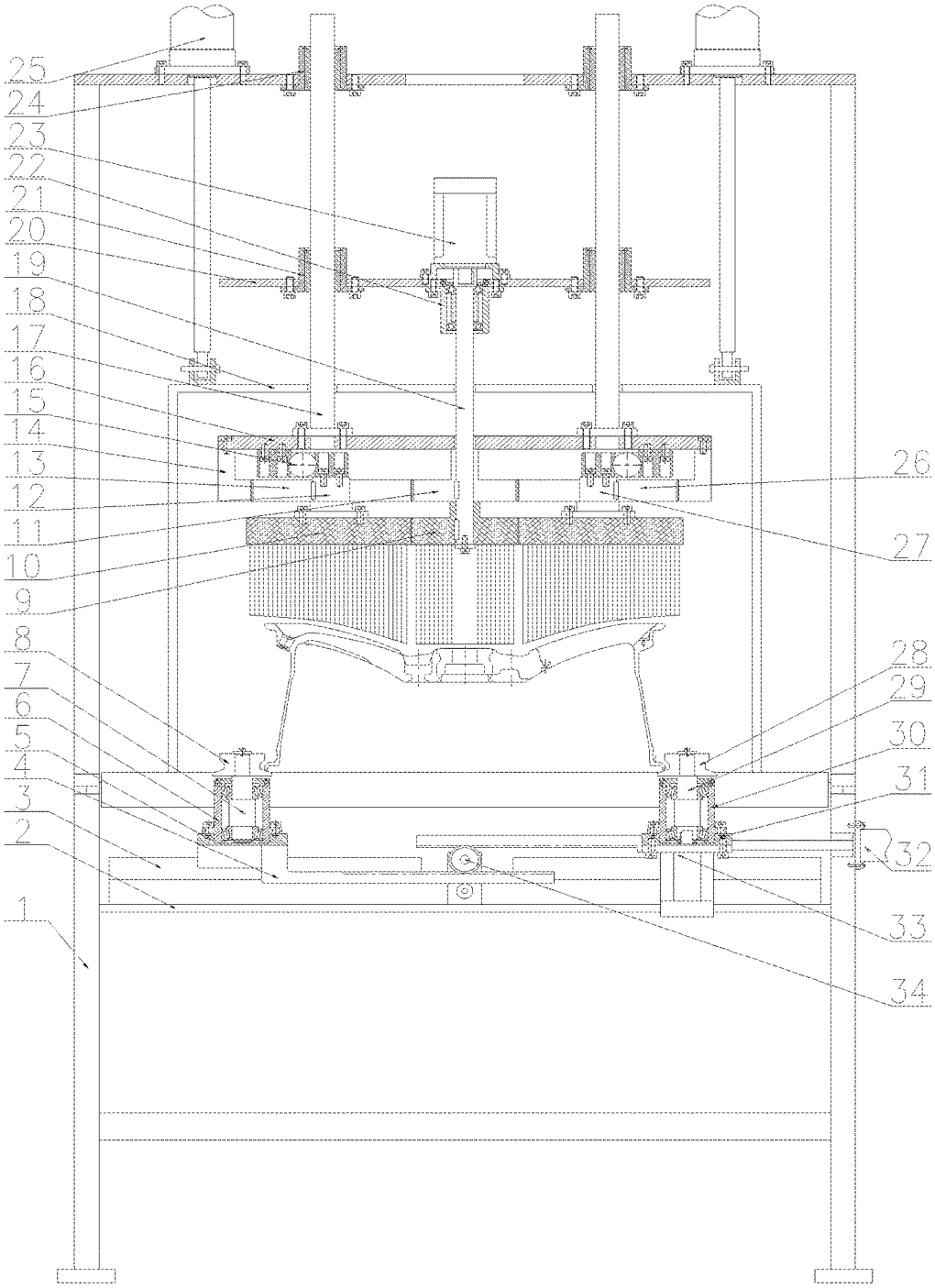
FIG. 1 is a front view of a device for burring a front face of a wheel provided by the present invention.
Figure 2:
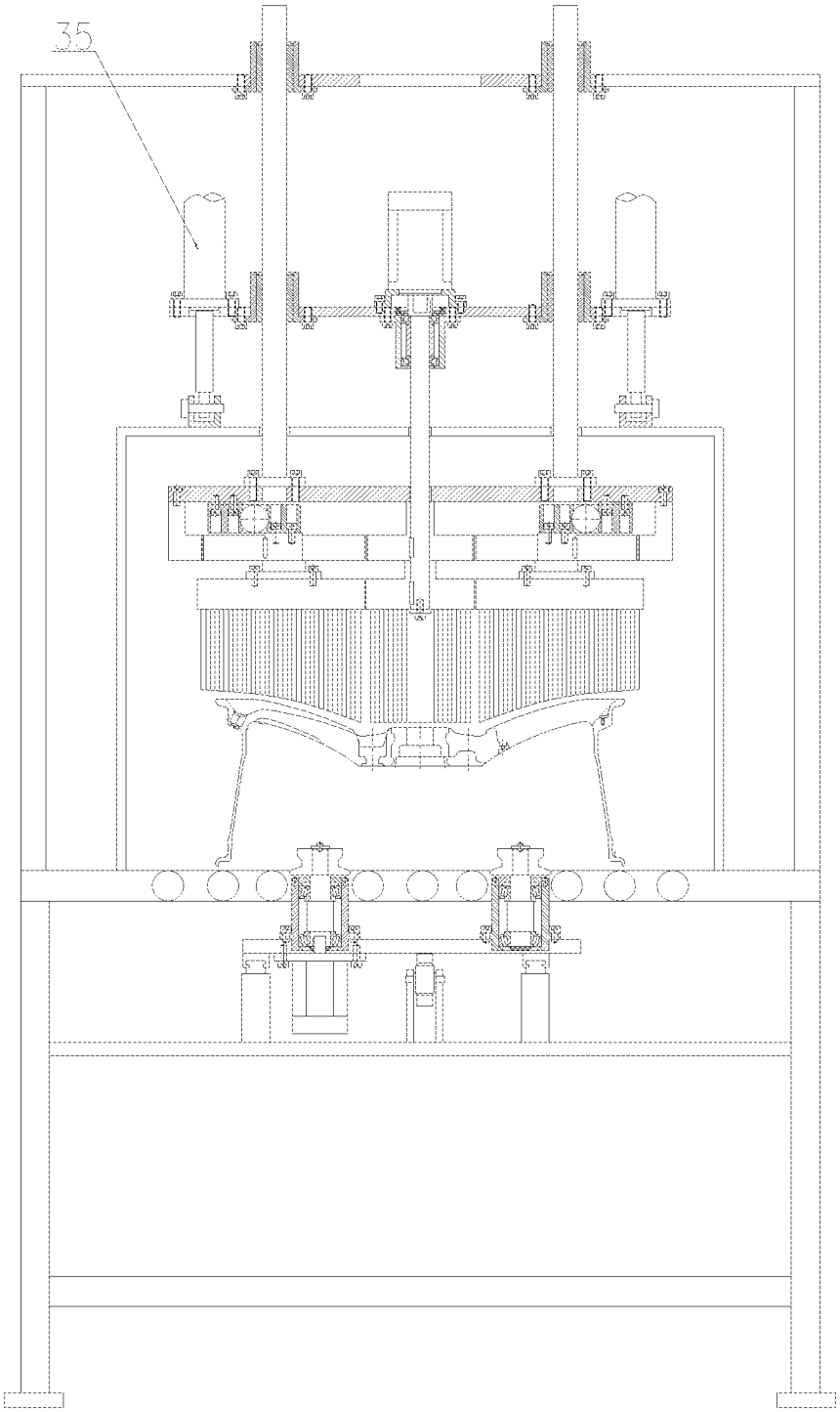
FIG. 2 is a top view of a device for burring a front face of a wheel provided by the present invention.

In the figures, 1—rack, 2—support plate, 3—guide rail, 4—gear rack, 5—left sliding plate, 6—left bearing block, 7—left shaft, 8—left roll, 9—central brush, 10—outer ring brush, 11—gear I, 12—shaft I, 13—gear II, 14—gear ring, 15—swivel, 16—fixed plate, 17—guide pillar, 18—dust cover, 19—shaft II, 20—lifting plate, 21—lower sliding sleeve, 22—lower bearing block, 23—motor, 24—upper sliding sleeve, 25—air cylinder I, 26—gear III, 27—shaft III, 28—right roll, 29—right shaft, 30—right bearing block, 31—right sliding plate, 32—clamping air cylinder, 33—servo motor, 34—synchronous gear, and 35—air cylinder II.

DETAILED DESCRIPTION OF THE INVENTION

In the following, the details and working conditions of a specific device provided by the present invention are described in combination with figures.

The device is composed of a rack 1, a support plate 2, a guide rail 3, gear racks 4, a left sliding plate 5, left bearing blocks 6, left shafts 7, left rolls 8, a central brush 9, an outer ring brush 10, a gear I 11, a shaft I 12, a gear II 13, a gear ring 14, a swivel 15, a fixed plate 16, guide pillars 17, a dust cover 18, a shaft II 19, a lifting plate 20, lower sliding sleeves 21, a lower bearing block 22, a motor 23, upper sliding sleeves 24, air cylinders I 25, a gear III 26, a shaft III 27, right rolls 28, right shafts 29, right bearing blocks 30, a right sliding plate 31, a clamping air cylinder 32, a servo motor 33, synchronous gears 34 and air cylinders II 35. The left sliding plate 5 on which the two left bearing blocks 6 are installed and under which the two gear racks 4 are installed is fixed above the support plate 2 via the guide rail 3. The two left shafts 7 on which the left rolls 8 are fixed are fixed in the left bearing blocks 6 via bearings. The fixed plate 16 is fixed under the four guide pillars 17. The gear ring 14 and the swivel 15 are fixed under the fixed plate 16. The gear I 11 is installed at the lower side of the shaft II 19, and fixed below the fixed plate 16. The central brush 9 is installed at the lowermost end of the shaft II 19, and fixed below the gear I 11. The shaft I 12 on which the gear II 13 is installed is fixed above the outer ring brush 10. The upper end of the shaft I 12 is fixed under the inner ring of the swivel 15. The shaft III 27 on which the gear III 26 is fixed is also fixed above the outer ring brush 10. The upper end of the III shaft 27 is also fixed under the inner ring of the swivel 15. The gear I 11 is simultaneously engaged with the gear II 13 and the gear III 26, and the gear II 13 and the gear III 26 are also simultaneously engaged with the gear ring 14. The central brush 9 is placed at the center of the outer ring brush 10, and forms a certain gap with the same. The shaft II 19 is fixed in the lower bearing block 22 under the lifting plate 20 via a bearing, and the upper end of the shaft II 19 is connected with the motor 23 fixed on the lifting plate 20.

The four lower sliding sleeves 21 fixed at corresponding positions of the lifting plate 20 are matched with the four guide pillars 17. The four upper sliding sleeves 24 fixed on the top of the rack 1 are also matched with the four guide pillars 17. The two air cylinders I 25 are fixed on the top of the rack 1, and the output ends of the air cylinders I 25 are hinged to the top of the dust cover 18. The two air cylinders II 35 are fixed on the top of the lifting plate 20, and the output ends of the air cylinders II 35 are also hinged to the top of the dust cover 18.

The right sliding plate 31 on which the two right bearing blocks 30 are fixed and under which the two gear racks 4 are fixed is fixed above the support plate 2 via the guide rail 3. The two right shafts 29 on which the right rolls 28 are fixed are fixed in the right bearing blocks 30 via bearings. The two synchronous gears 34 are fixed above the support plate 2, and simultaneously engaged with the two gear racks 4 on the left and right sides. The servo motor 33 is fixed under the right sliding plate 31, and the output end of the servo motor 33 is connected with one right shaft 29. The clamping air cylinder 32 is fixed on one side of the rack 1, and the output end of the clamping air cylinder 32 is connected with the right sliding plate 31.

The gear II 13 and the gear III 26 are the same in module and number of teeth, the gear I 11 has the same module as the gear II 13 and the gear III 26, and the number of teeth of the gear I 11 is half of that of the gear II 13 and the gear III 26.

During a working process, a sensor enables a wheel to be positioned on a roller way, the clamping air cylinder 32 drives the two left rolls 8 and the two right rolls 28 via the synchronous gears 34 and the gear racks 4 to clamp the wheel, a servo motor 33 drives the wheel to rotate at relatively low speed under the clamped condition, and the rotation direction of the wheel is opposite to that of the brushes. The air cylinders I 25 enable the dust cover 18 to go down, and the motor 23 drives the gear I 11 and the central brush 9 via the shaft II 19 to rotate at relatively high speed. The gear I 11 drives the gear II 13 and the gear III 26 to simultaneously rotate at slightly slow speed, so as to drive the outer ring brush 10 to also rotate at relatively slow speed. The air cylinders II 35 drive the central brush 9 and the outer ring brush 10 to go down, and burring can be performed once the central brush and the outer ring brush contact the front face of the wheel.

What is claimed is:

1. A device for burring a front face of a wheel, comprising: a rack (1), a support plate (2), a guide rail (3), two gear racks (4), a left sliding plate (5), left bearing blocks (6), left shafts (7), left rolls (8), a central brush (9), an outer ring brush (10), a gear I (11), a shaft I (12), a gear II (13), a gear ring (14), a swivel (15), a fixed plate (16), four guide pillars (17), a dust cover (18), a shaft II (19), a lifting plate (20), four lower sliding sleeves (21), a lower bearing block (22), a motor (23), four upper sliding sleeves (24), two air cylinders I (25), a gear III (26), a shaft III (27), right rolls (28), two right shafts (29), two right bearing blocks (30), a right sliding plate (31), a clamping air cylinder (32), a servo motor (33), synchronous gears (34) and air cylinders II (35); characterized in that the left sliding plate (5) on which the two left bearing blocks (6) are installed and under which the two gear racks (4) are installed is fixed above the support plate (2) via the guide rail (3); the two left shafts (7) on which the left rolls (8) are fixed are fixed in the left bearing blocks (6) via bearings; the fixed plate (16) is fixed under the four guide pillars (17); the gear ring (14) and the swivel (15) are fixed under the fixed plate (16); the gear I (11) is installed at the lower side of the shaft II (19), and fixed below the fixed plate (16); the central brush (9) is installed at a lowermost end of the shaft II (19), and fixed below the gear I (11); the shaft I (12) on which the gear II (13) is installed is fixed above the outer ring brush (10); the upper end of the shaft I (12) is fixed under an inner ring of the swivel (15); the shaft III (27) on which the gear III (26) is fixed is also fixed above the outer ring brush (10); the upper end of the shaft III (27) is also fixed under the inner ring of the swivel (15); the gear I (11) is simultaneously engaged with the gear II (13) and the gear III (26), and the gear II (13) and the gear III (26) are also simultaneously engaged with the gear ring (14); the central brush (9) is placed at the center of the outer ring brush (10), and forms a certain gap with the same; the shaft II (19) is fixed in the lower bearing block (22) under the lifting plate (20) via a bearing; and the upper end of the shaft II (19) is connected with the motor (23) fixed on the lifting plate (20);

the four lower sliding sleeves (21) fixed at corresponding positions of the lifting plate (20) are matched with the four guide pillars (17); the four upper sliding sleeves (24) fixed on the top of the rack (1) are also matched with the four guide pillars (17); the two air cylinders I (25) are fixed on the top of the rack (1), and the output ends of the air cylinders I (25) are hinged to the top of the dust cover (18); the two air cylinders II (35) are fixed on the top of the lifting plate (20), and output ends of the air cylinders II (35) are also hinged to the top of the dust cover (18);

the right sliding plate (31) on which the two right bearing blocks (30) are fixed and under which the two gear racks (4) are fixed is fixed above the support plate (2) via the guide rail (3); the two right shafts (29) on which the right rolls (28) are fixed are fixed in the right bearing blocks (30) via bearings; the two synchronous gears (34) are fixed above the support plate (2), and simultaneously engaged with the two gear racks (4) on the left and right sides; the servo motor (33) is fixed under the right sliding plate (31), and an output end of the servo motor (33) is connected with one right shaft (29); and the clamping air cylinder (32) is fixed on one side of the rack (1), and an output end of the clamping air cylinder (32) is connected with the right sliding plate (31).

2. The device for burring a front face of a wheel according to claim 1, characterized in that the gear II (13) and the gear III (26) are the same in module and number of teeth, the gear I (11) has the same module as the gear II (13) and the gear III (26), and the number of teeth of the gear I (11) is half of that of the gear II (13) and the gear III (26).

* * * * *